US005316155A

United States Patent [19]

Collins et al.

[11] Patent Number: 5,316,155

[45] Date of Patent: May 31, 1994

[54] SKI RACK

[76] Inventors: Antony P. Collins, 67 Ilam Road; Alfred B. Wright, 29 Kirkwood Avenue, both of Christchurch, New Zealand

[21] Appl. No.: 953,476

[22] Filed: Sep. 28, 1992

[30] Foreign Application Priority Data

Sep. 28, 1991 [NZ] New Zealand ..... 239035

[51] Int. Cl.[5] ..... A47F 7/00

[52] U.S. Cl. ..... 211/70.5; 70/58; 211/4; 211/87; D6/552

[58] Field of Search ..... 211/70.5, 4, 87; 70/58, 70/62; D6/552

[56] References Cited

U.S. PATENT DOCUMENTS 2,919,032 12/1959 Sinawski ..... 211/70.5
3,685,667 8/1972 Bell ..... 211/70.5
4,062,453 12/1977 Gorlach ..... 211/70.5
4,778,065 10/1988 Chiarot ..... 211/70.5
5,147,049 9/1992 Schwendemann et al. ..... 211/4 X

FOREIGN PATENT DOCUMENTS 1335767 7/1963 France ..... 211/70.5

*Primary Examiner*—Robert W. Gibson, Jr.
*Attorney, Agent, or Firm*—Christensen, O'Connor, Johnson & Kindness

[57] ABSTRACT

A ski rack which includes a frame from which extends a ski retaining section, the ski retaining section being dimensioned and adapted to support a set of skis by a binding of the skis. Each ski retaining section can be shaped and dimensioned to hold therein a set of skis and optionally a set of poles. The ski retaining section is shaped and dimensioned so that when a set of skis have been joined together with their bases facing each other, the ski bindings are lifted over upstands which extend from the ski retaining section before the skis are fitted into an open U-shaped, in plan, region formed by the ski retaining section.

9 Claims, 6 Drawing Sheets

SKI RACK

FIELD OF INVENTION

The invention relates to ski racks and particularly to a rack for storing sets of skis and optionally poles in a simple and convenient manner.

BACKGROUND OF THE INVENTION

At present most people store their skis in homemade racks or they are placed in corners when they are not in use. This is unsightly and a waste of space.

An object of the invention is to provide a simple inexpensive ski rack for one or more sets of skis and optionally poles which at least offers consumers a useful alternative choice.

Further objects and advantages of the invention will become apparent from the following description which is given by way of example only.

SUMMARY OF THE INVENTION

According to a first aspect of the invention there is provided a ski rack which includes a frame from which extends a ski retaining section, the ski retaining section being dimensioned and adapted to support a set of skis by a binding of the skis.

According to a second aspect of the invention there is provided a ski rack including one or more ski retaining sections, each ski retaining section being shaped and dimensioned to hold therein a set of skis and optionally a set of poles, the arrangement being such that each ski retaining section is adapted to support the skis or ski bindings to thereby retain the skis in the rack.

According to a third aspect of the invention there is provided a ski rack comprising two or more ski retaining sections, each ski retaining section being shaped and dimensioned to hold therein at least one set of skis and at least one set of poles, each ski retaining section is, in side view, shaped to have sitting thereon front or rear bindings of a set of skis.

The ski retaining sections can be mounted in pairs so that each set of skis is supported between ski retaining sections at least one of which is dimensioned to support the weight of the skis and bindings.

The ski retaining section is shaped and dimensioned so that when a set of skis have been joined together in a position with their bases facing each other, the ski bindings which are attached to the skis are lifted over upstands which extend from the ski retaining section before the skis are fitted into an open U-shaped, in plan, region formed by the ski retaining section. The other ski retaining sections can be similarly shaped so that the ski bindings of the skis are lifted over the upstands to allow the bindings to locate the skis into the U-shaped, in plan, region.

Each ski retaining section can be formed as a U-shaped member, in plan, and dimensioned so that the open side of the U-shaped member is about the width of a set of skis held in juxtaposition. Each side of the U-shaped member of the ski retaining section can include an upstand so that in side elevation the section is L-shaped. The upper end of the upstand can include a curved region. The curved region of an upper ski retaining section can be adapted to be linked by either a chain and padlock or similar key locking device such as, for example, a coin operated device to enable the skis to be locked into the ski rack.

The ski rack can be a modular system manufactured from a metal or metal alloy material and each module is designed to support two sets of skis in either a horizontal or vertical position.

For further understanding of the nature and advantages of the invention reference should be made to the ensuing detailed description taken in conjunction with the accompanying drawings.

DESCRIPTION OF THE PREFERRED EMBODIMENTS

The first embodiment which will be described with reference to FIGS. 1 to 5 of the accompanying drawings will be with reference to a ski rack mounted on a wall. It is however to be appreciated that with minor modifications the invention can be hung from a ceiling or fixed in any orientation to suit a user's requirements. The embodiments shown in FIGS. 1 to 5 (inclusive) and FIG. 7 are a single module of a kitset version of the ski rack.

Figure 7:
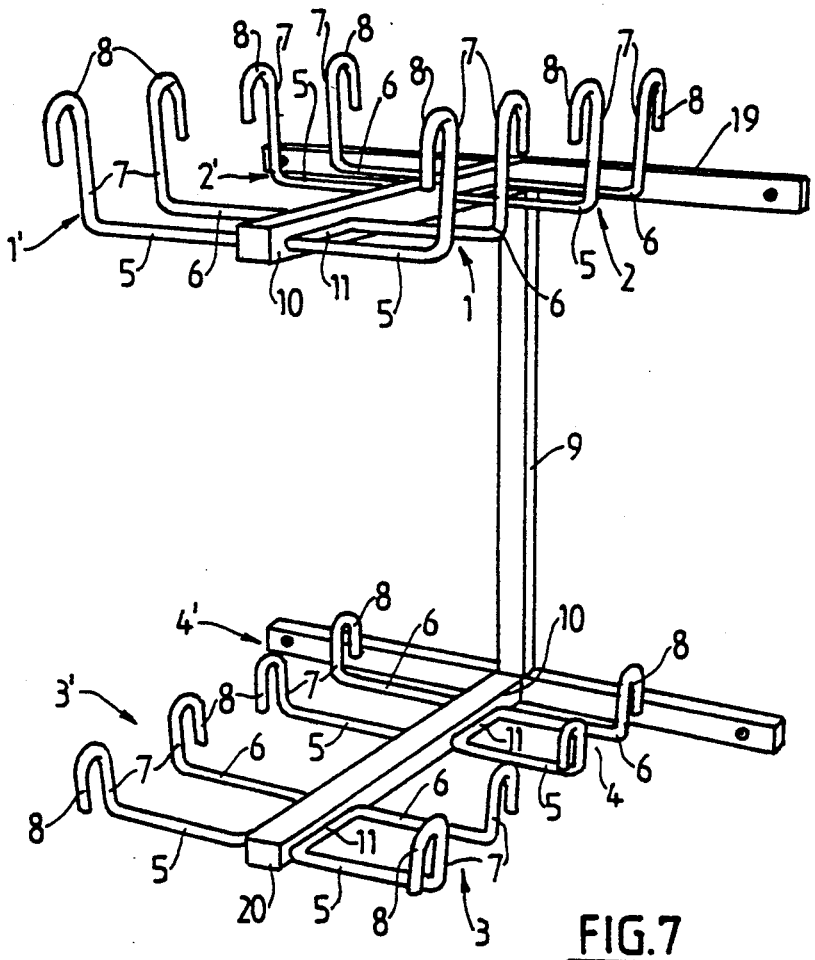
FIG. 7 is yet another version of the ski rack.

The ski rack shown in these embodiemnts include two sets of ski retaining sections 1, 2, 3 and 4 respectively in FIGS. 1 to 5 and sections 1, 1', 2, 2', 3, 3', 4 and 4' in FIGS. 7. Each of the ski retaining sections is in plan U-shaped with arms 5 & 6 on which ski bindings may sit. The arms 5 & 6 each have upstands 7. The ski retaining sections are be mounted on a frame which in the example consist of vertical members 9 which are extendible and horizontal members 10 which are linked together by bolts, welding, or other means of attachment to form the frame members. The frame members 9 and 10 can be manufactured from box section or other suitable metal or other materials. The ski retaining sections are manufactured from a plastics material or metal rod bent to the shape shown and can be coated with an epoxy or other protective coating.

Figure 1:
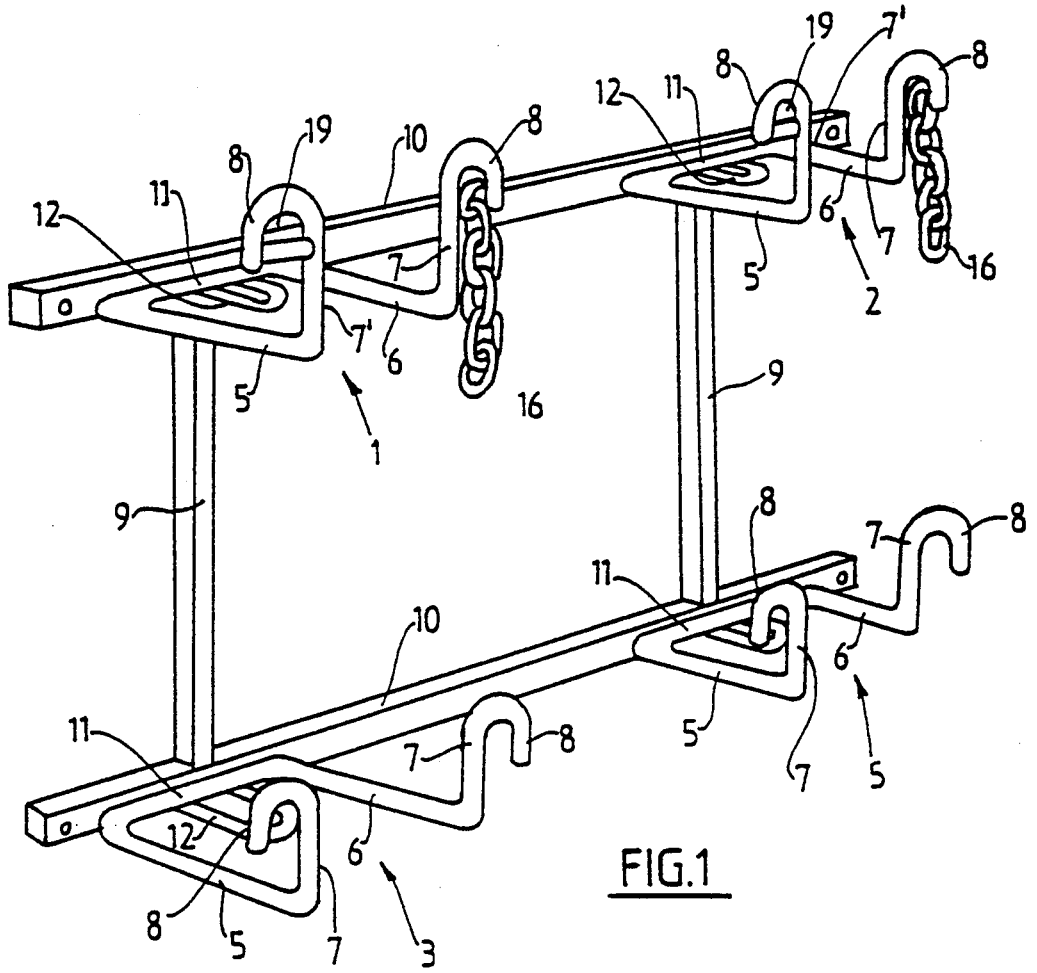
FIG. 1 is a perspective view from the front of one side of a first example of the ski rack according to the invention.
Figure 4:
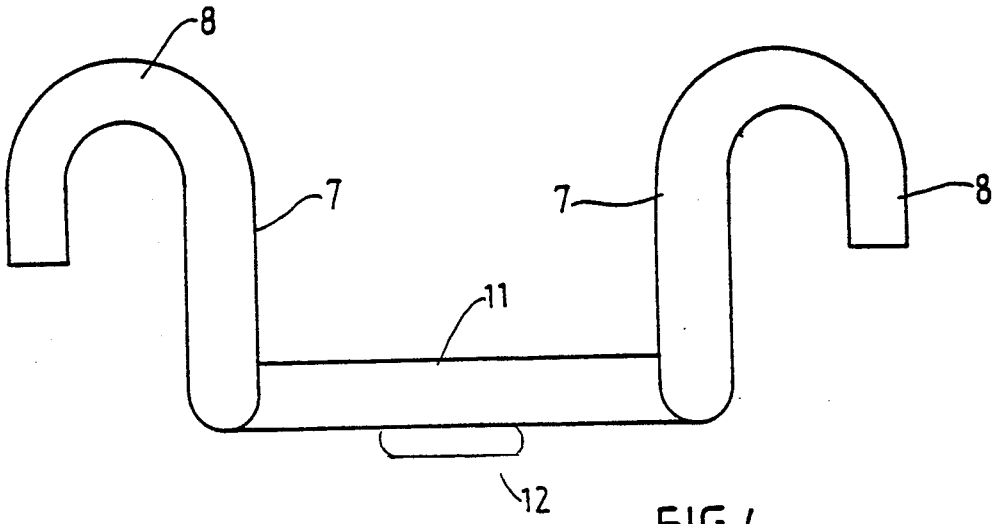
FIG. 4 is a plan view of a lower set of ski retaining sections.
Figure 3:
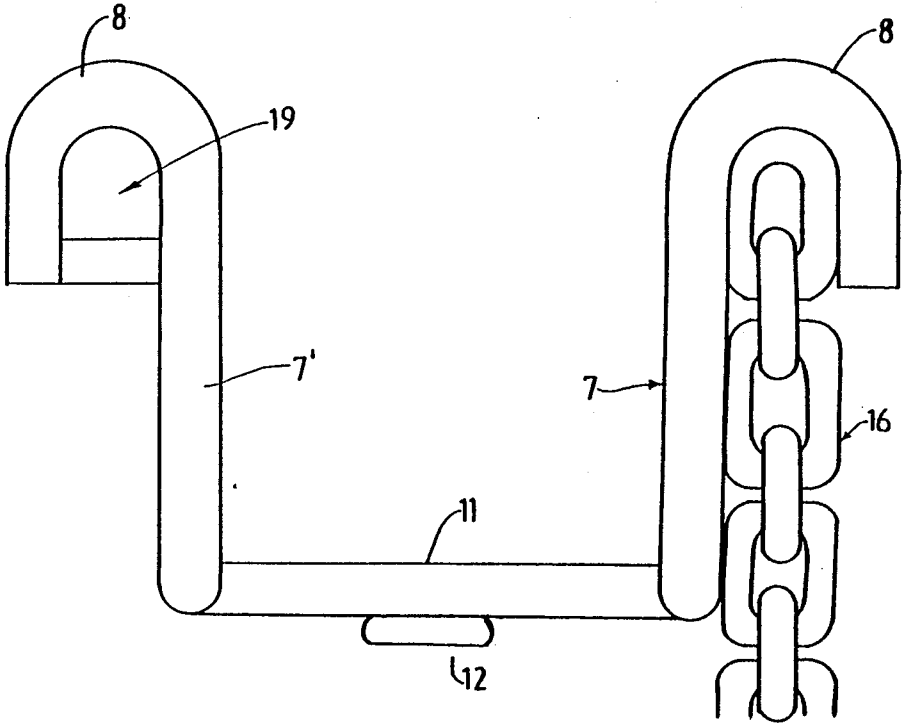
FIG. 3 is a front view of the set of ski retaining sections shown in FIG. 2.
Figure 2:
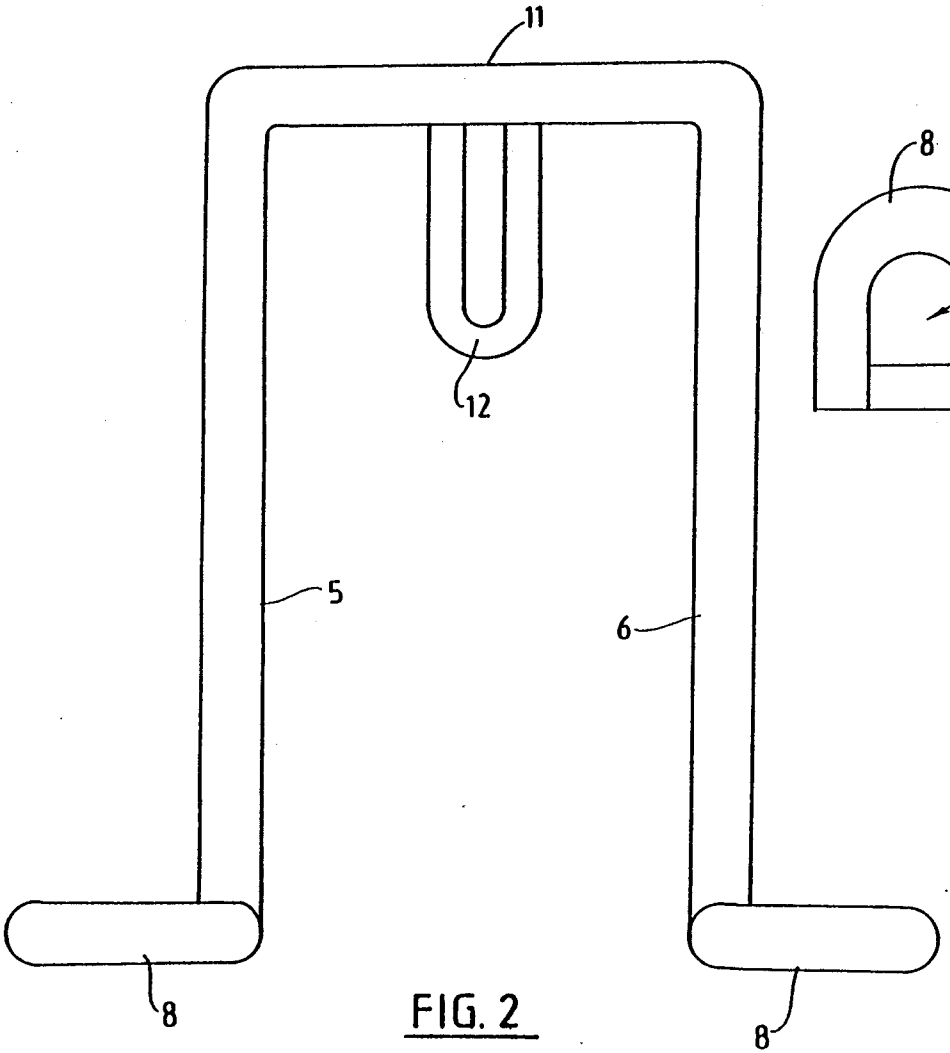
FIG. 2 is a plan view of an upper or lower set of ski retaining sections.

The ski retaining sections are joined to the frame members by the central section 11 of the U-shaped regions. Each central section 11 in conjunction with an extension 12 (not shown in FIG. 7) is shaped to provide ski pole retaining sections as shown in FIGS. 1 and 2. In use ski poles 18 in FIG. 5 are inserted by feeding them between the arms 5, 6 until the handles 17 of the ski poles rest between the extension 12 and one of the arms.

Figure 5:
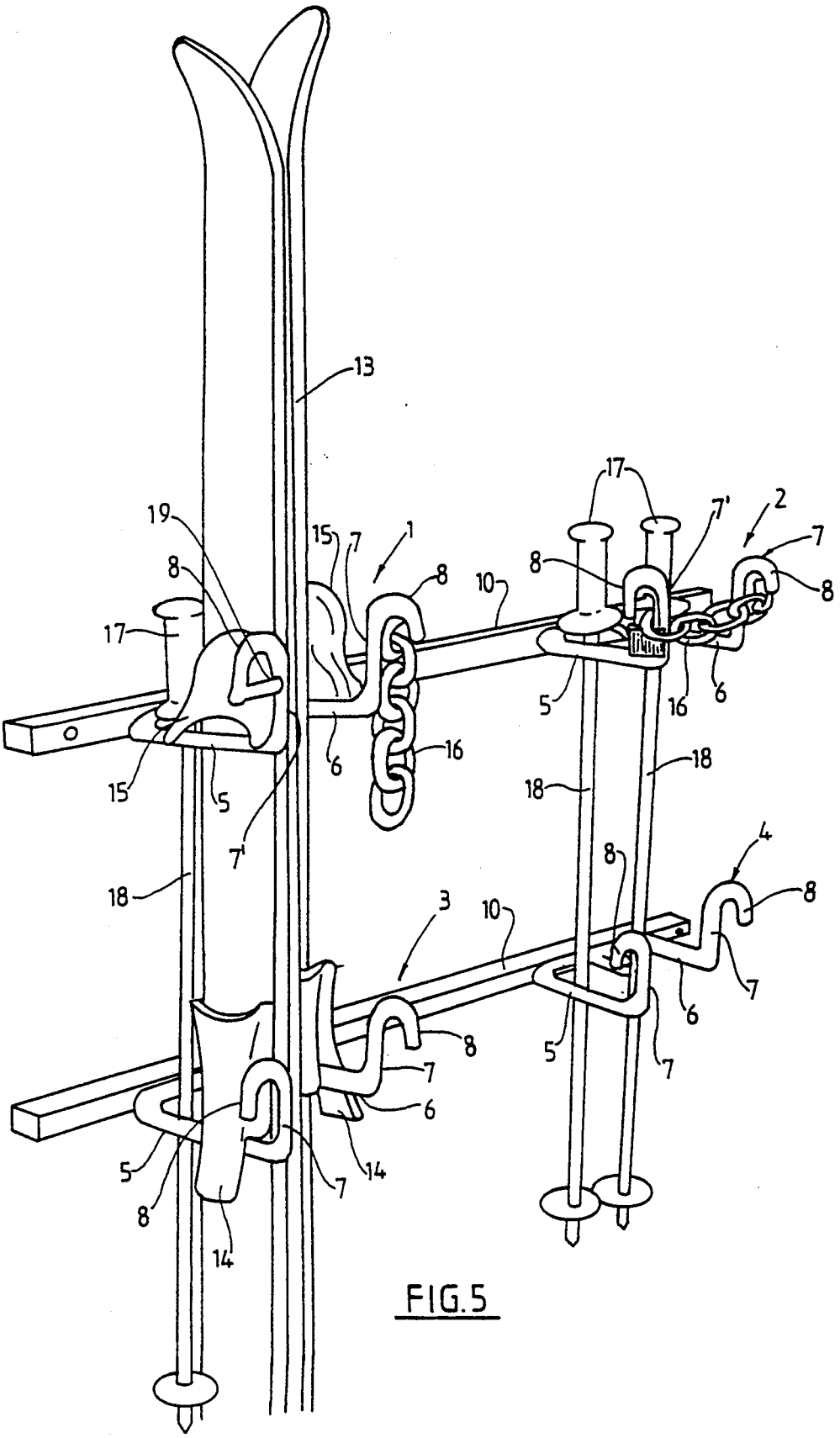
FIG. 5 is the rack shown in FIG. 1 with a set of skis and two sets of poles fitted therein.

The sets of skis 13 only one set of which is shown in FIG. 5 are placed together in the ski retaining sections with the skis together with their bases facing each other. The skis are lifted over the upstands 7 of the arms such that the rear binding 14 of the skis then rests on the lower ski retaining sections 3 and 4. The front bindings 15 rest on the upper ski retaining sections 1 and 2 to hold the skis in a vertical position.

Attached to the upstand of one of the arms is a chain or safety catch 16 or other suitable locking device which allows the user to lock the skis and poles in place. This is only shown in the first example, however, it can be incorporated in the example shown in FIG. 7.

The skis can be locked in place by attaching a chain to one of the curved ends 8 of the upstand 7.

The chain can be attached to the eye 19 of the adjacent upstand 7 by any suitable locking device.

Figure 6:
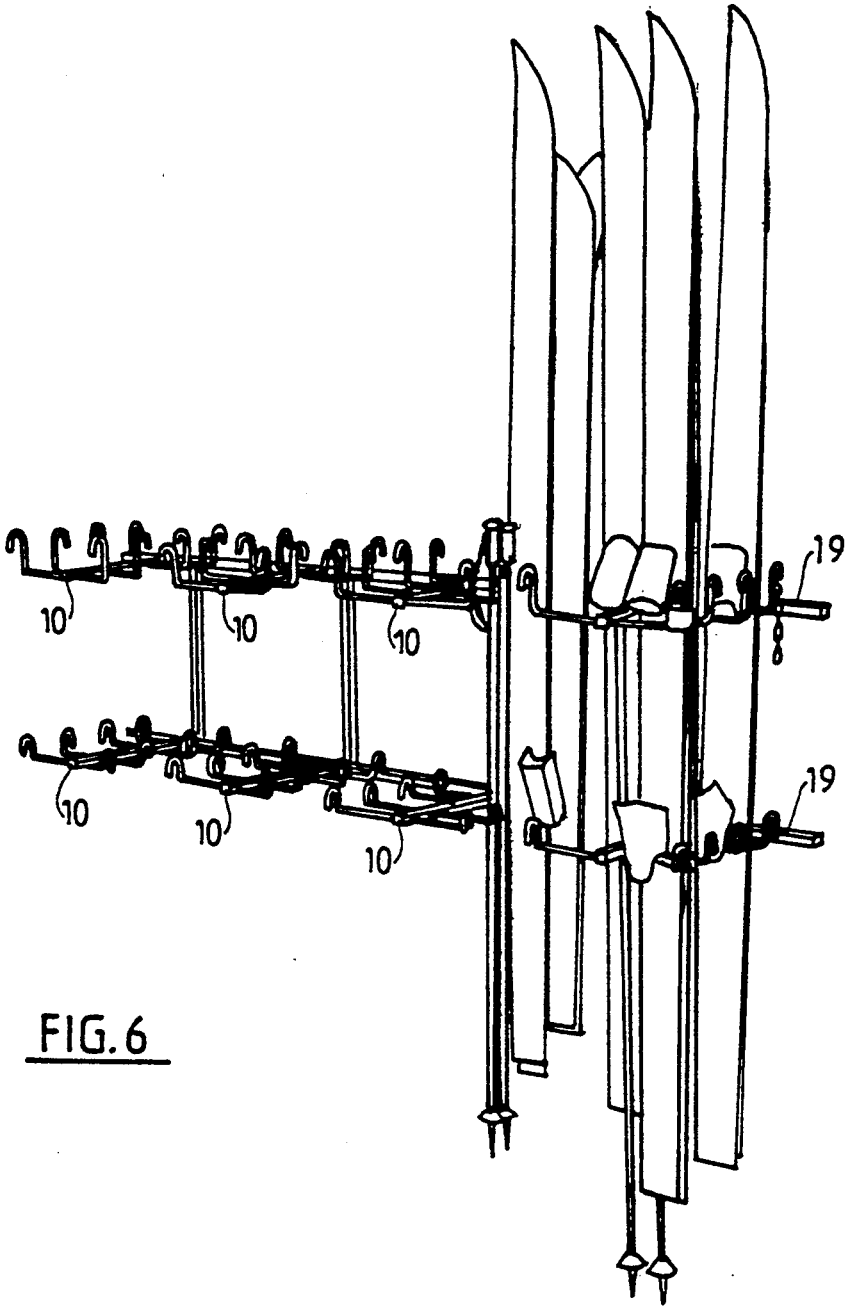
FIG. 6 is a further version of the ski rack.

In FIG. 6 the ski retaining sections are mounted on horizontal members 10 which extends perpendicular to a frame members 19. This arrangement enables the skis to be supported and removed from both sides of the member 10 of the ski rack.

In FIG. 7 the ski rack is designed for skis only. The extension 12 is absent from this arrangement.

Figure 8:
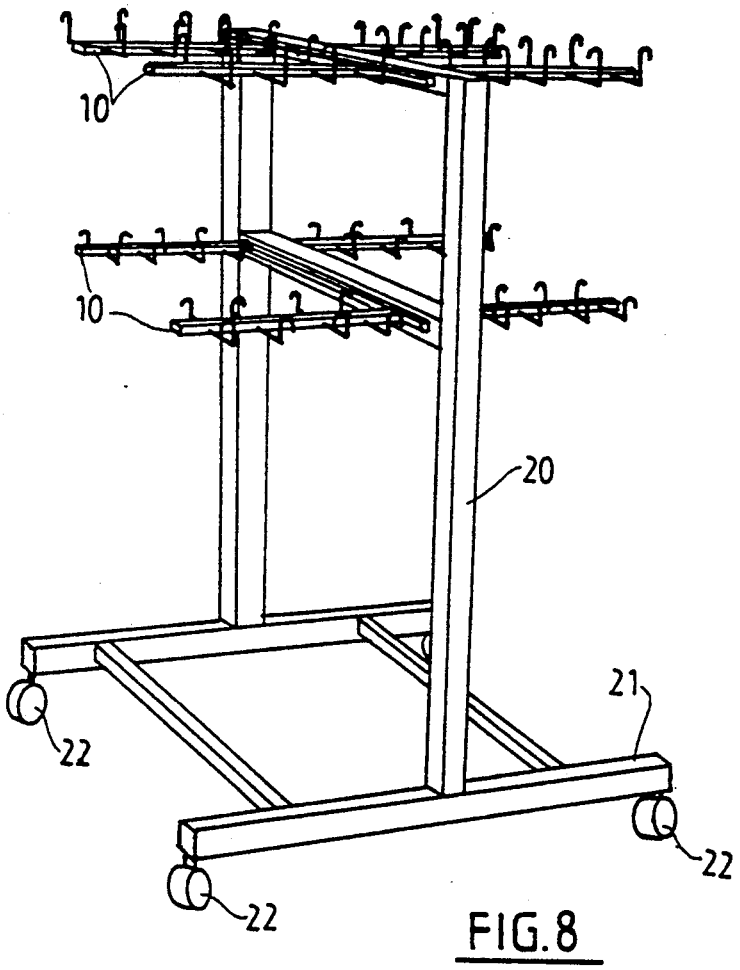
FIG. 8 is yet another version of the ski rack.

In FIG. 8 the frame members 19 of the single modules of the ski rack shown in FIG. 7 have been joined together by bolting, welding or other means of attachment to a modular storage or display stand 20. The modular storage or display stand 20 can be mounted on a base 21, which may be movable, on wheels 22 or other suitable means.

As the unit is modular it is envisaged that a block or other linking mechanism can be provided which is either fitted between adjacent sets of similar frame members or adapted to link them together to provide for extensive storage or display capabilities.

Thus by this invention there is provided an inexpensive ski rack for one or more more sets of skis with or without poles.

Particular examples of this invention have been described and it is envisaged that improvements and modifications can take place without departing from the scope and spirit of the appended claims.

What we do claim and desire to obtain by Letters Patent in the United States is:

1. A ski rack that comprises a frame with at least one pair of ski-retaining sections mounted thereon, the ski-retaining sections of each pair being spaced above each other and dimensioned and shaped to retain upright therein a set of skis that are positioned together with their bases facing each other and with their bindings facing outward, the bindings of the set of skis being retained by the ski-retaining sections, which have U-shaped regions, the outer ends of the U-shaped regions having an upstanding member on each side, the U-shaped regions and upstanding member of each ski-retaining section being adapted to retain the sets of skis in position against accidental release, the upper and lower ski-retaining sections being spaced apart so that rear bindings of the skis rest on the lower ski-retaining section with the front bindings contained by the upper ski-retaining sections.

2. A ski rack as claimed in claim 1, wherein the U-shaped regions are shaped and dimensioned to additionally hold a set of ski poles.

3. A ski rack as claimed in claim 2, wherein the upstanding members are U-shaped in front elevation.

4. A ski rack as claimed in claim 3, wherein a back of each U-shaped region has an extension that, with arms of the U-shaped region, holds handles of a set of ski poles in position on the frame.

5. A ski rack as claimed in claim 4, wherein an upper end of a first of the upstanding members is closed to form an eye so that an end of a chain attached to the opposite upstanding member can be padlocked to the first upstanding member to lock the set of skis in position.

6. A ski rack as claimed in claim 5, in which the frame has two pairs of ski-retaining sections mounted thereon.

7. A ski rack as claimed in claim 6, wherein the ski rack is modular.

8. A ski rack as claimed in claim 7, wherein the ski rack is kitset.

9. A ski rack as claimed in claim 6, wherein the ski rack is kitset.

* * * * *